US005715501A

United States Patent [19]

Aita et al.

[11] Patent Number: 5,715,501

[45] Date of Patent: Feb. 3, 1998

[54] IMAGE FORMING METHOD USING A SURFACE WITH A SPECIFIED WATER CONTACT ANGLE AND PROCESS CARTRIDGE USING SUCH A METHOD

[75] Inventors: Shuichi Aita, Yokohama; Toshiyuki Yoshihara, Kawasaki; Motoo Urawa; Tsutomu Kukimoto, both of Yokohama; Yoshifumi Hano, Inagi, all of Japan

[73] Assignee: Canon Kabushiki Kaisha, Tokyo, Japan

[21] Appl. No.: 770,408

[22] Filed: Jan. 22, 1997

Related U.S. Application Data

[63] Continuation of Ser. No. 421,185, Apr. 13, 1995, abandoned.

[30] Foreign Application Priority Data

Apr. 15, 1994 [JP] Japan ..... 6-101556
Nov. 8, 1994 [JP] Japan ..... 6-298018

[51] Int. Cl.[6] ..... G03G 15/00; G03G 13/08; G03G 5/00

[52] U.S. Cl. ..... 399/159; 430/111

[58] Field of Search ..... 399/159, 252; 430/66, 67, 111

[56] References Cited

U.S. PATENT DOCUMENTS

| | | | |
|---|---|---|---|
| 4,957,840 | 9/1990 | Sakashita et al. | 430/106.6 |
| 5,014,089 | 5/1991 | Sakashita et al. | 355/251 |
| 5,073,466 | 12/1991 | Ishikawa et al. | 430/66 |
| 5,137,796 | 8/1992 | Takiguchi et al. | 430/106.6 |
| 5,139,912 | 8/1992 | Aizawa | 430/67 |
| 5,252,418 | 10/1993 | Ishikawa et al. | 430/67 |
| 5,262,267 | 11/1993 | Takiguchi et al. | 430/122 |
| 5,310,615 | 5/1994 | Tanikawa | 430/106.6 |
| 5,357,320 | 10/1994 | Kashimura et al. | 355/211 |

FOREIGN PATENT DOCUMENTS

| | | |
|---|---|---|
| 0314459 | 5/1989 | European Pat. Off. . |
| 0482665 | 4/1992 | European Pat. Off. . |
| 0589776 | 3/1994 | European Pat. Off. . |
| 60-2968 | 1/1985 | Japan . |
| 1-112253 | 4/1989 | Japan . |
| 1-191156 | 8/1989 | Japan . |
| 2-214156 | 8/1990 | Japan . |
| 2-284158 | 11/1990 | Japan . |
| 3-172856 | 7/1991 | Japan . |
| 3-181952 | 8/1991 | Japan . |
| 4-69667 | 3/1992 | Japan . |
| 4-162048 | 6/1992 | Japan . |
| 5-188752 | 7/1993 | Japan . |
| 5-188765 | 7/1993 | Japan . |
| 5-257315 | 10/1993 | Japan . |
| 6-11885 | 1/1994 | Japan . |
| 6-95416 | 4/1994 | Japan . |

OTHER PUBLICATIONS

H. Watanabe, F. Hirano, and H. Uchimura, Compact Page Printer, Fujitsu Scientific & Technical Journal Winter 1992, vol. 28, No. 4, Dec. 1992, pp. 473–480.

*Primary Examiner*—Joan H. Pendegrass
*Attorney, Agent, or Firm*—Fitzpatrick, Cella, Harper & Scinto

[57] ABSTRACT

An image forming method includes forming an electrostatic latent image on an image bearing member having a surface of which contact angle with water is at least 90°, forming a toner layer on a toner carrying member, bringing the toner layer into contact with the surface of the image bearing member on which the electrostatic latent image has been formed, while rotating the image bearing member and the toner carrying member reciprocally, and developing the electrostatic latent image by the use of the toner of the toner layer to form a toner image.

33 Claims, 5 Drawing Sheets

IMAGE FORMING METHOD USING A SURFACE WITH A SPECIFIED WATER CONTACT ANGLE AND PROCESS CARTRIDGE USING SUCH A METHOD

This application is a continuation of application Ser. No. 08/421,185, filed Apr. 13, 1995, now abandoned.

BACKGROUND OF THE INVENTION

1. Field of the Invention

This invention relates to an image forming method for developing an electrostatic latent image, and to a process cartridge.

2. Related Background Art

A large number of methods are hitherto known for electrophotography. In general, copies or prints are obtained by forming an electrical latent image (e.g., an electrostatic latent image) on an image bearing member (a photosensitive member) by various methods utilizing a photoconductive material, subsequently developing the latent image with a toner to form a visible toner image, transferring the toner image to a transfer medium such as paper directly or after transferring the toner image to an intermediate transfer medium, and then fixing the toner image to the transfer medium, by a heating, pressing or heating and pressing means.

Developing methods known in the art to make the electrical latent image visible, include cascade development, magnetic brush development, pressure development and so forth. A method is also known in which, the toner is a magnetic toner and the toner carrying member is a rotary developing sleeve provided with magnet in it, and magnetic toner flies to the image bearing member due to the electric field formed between the sleeve and the image bearing member.

A one-component development system does not need carrier particles such as glass beads, iron powder or magnetic ferrite particles used in two-component development systems, and hence it allows down-sizing of the developing assemblies. The two-component development system also requires a device for supplying a necessary quantity of toner to maintain the toner concentration in the developer, increasing the size and weight of the developing assemblies. With the one-component development system, such a device is not required and the developing assemblies can be advantageously made compact and light-weighted.

Recently, LED and LBP printers have been prevailing in the printer market. The trend of techniques is toward those having higher resolution of 400, 600 or 800 dpi rather than those having a resolution of 240 or 300 dpi. Accordingly, more minuteness is now required for the development system. In the field of copying machines, higher performance is also required for the machines, thus they are heading toward digital systems. Most of such digital machines are using a laser to form electrostatic latent images, and heading toward higher resolution and higher minuteness like the printers. Therefore, it has been long sought to provide a development system with a high resolution and high minuteness. For this purpose, toners has become to have smaller particle diameters. For example, Japanese Patent Applications Laid-open No. 1-112253, No. 1-191156, No. 2-214156, No. 2-284158, No. 3-181952 and No. 4-162048 disclose toners having small particle diameters with specific particle size distributions.

In recent years, one-component contact development systems are proposed in which development is carried out by pressing a semiconductive developing roller or a developing roller having a dielectric layer on its surface, against the surface of an image bearing member. Techniques concerning such one component-contact development are described, for example, in Japan Hardcopy '89 Papers, pp.25–28, FUJITSU Sci. Tech. J., 28, 4, pp.473–480 (December 1992), and Japanese Patent Applications Laid-open No. 5-188765 and No. 5-188752.

In the one-component contact development system, the surface of the image bearing member and the developing electrode stand very close to each other, hence there is an advantage that the edge effect in development can be decreased.

Since, however, the surface of the image bearing member comes into contact with or touch the toner carrying member, it is difficult to increase the process speed and also it is difficult to improve running durability in copying on a large number of sheets.

For the one component-contact development system, it is essential that the image bearing member rubs the toner and the toner carrying member. For this reason, deterioration of the toner, surface deterioration or wear of the toner carrying member and the image bearing member may occur when used for a long time. Thus, the system has problems in running durability properties and the improvement of running durability has been sought.

The edge effect can be prevented by making distance between the image bearing member and toner carrying member very small, but it is difficult to set the gap between them smaller than the thickness of the toner layer on the toner carrying member.

After all, the toner carrying member is pressed against the image bearing member to prevent the edge effect. When the moving speed of the toner carrying member surface is equal to that of the image bearing member surface, it is difficult to obtain a satisfactory image after the development of the latent image on the image bearing member. On the other hand, when the moving speed of the toner carrying member surface and that of the image bearing member surface are made different, the toner on the toner carrying member is transferred to the image bearing member at the latent image area and at the same time some of the toner is taken off, so that the resulting toner image is very faithful to the latent image and free from edge effect.

Japan Hardcopy '89 Papers, pp.25–28, reports investigation on a non-magnetic, one-component contact development system. It, however, does not refer to its running durability.

FUJITSU Sci. Tech. J., 28, 4, pp.473–480 (December 1992) reports an outline of a printer employing a one-component contact development system. The running durability of it, however, is not satisfactory, and more improvement is desired.

Japanese Patent Applications Laid-open No. 5-188765 and No. 5-188752 disclose a technique relating to the one-component contact development system, but no specific techniques to improve the running durability is disclosed.

Recently, becoming more conscious of saving the natural resources, it has been required to reduce toner consumption (the quantity of toner used/image) more than ever.

SUMMARY OF THE INVENTION

An object of the present invention is to provide an image forming method, and a process cartridge, that have solved the problems in the prior art discussed above.

Another object of the present invention is to provide an image forming method, and a process cartridge, that can enjoy a smaller toner consumption than previous devices.

Still another object of the present invention is to provide an image forming method and a process cartridge, that provide images of high image density and of image sharpness even with a latent image of minute spots.

A further object of the present invention is to provide an image forming method and a process cartridge, that improve the toner deterioration during development of an electrostatic latent image formed on an image bearing member, wherein the toner on a toner carrying member comes into contact with the image bearing member and the toner carrying member substantially comes into contact with the image bearing member through the toner.

A still further object of the present invention is to provide an image forming method and a process cartridge, where the surface deterioration of the toner carrying member is improved.

A still further object of the present invention is to provide an image forming method and a process cartridge, that enables more speedy operation of developing assemblies.

A still further object of the present invention is to provide an image forming method, and a process cartridge, utilizing an image bearing member which is resistant to deterioration.

The present invention provides an image forming method comprising;

forming an electrostatic latent image on an image bearing member, a surface of which has a contact angle with water of at least 90°;

forming a toner layer on a toner carrying member;

bringing the toner layer into contact with the surface of the image bearing member on which the electrostatic latent image has been formed, while making the image bearing member and the toner carrying member rotate reciprocally; and developing the electrostatic latent image with the toner of the toner layer to form a toner image.

The present invention also provides a process cartridge comprising a developing means and an image bearing member for bearing an electrostatic latent image;

the developing means and the image bearing member are held into one unit as a cartridge; and the process cartridge is detachable from the main body of an image forming apparatus, wherein;

the surface of the image bearing member has a contact angle with water of at least 90°; and the developing means comprises a toner and a toner carrying member which are assembled to develop the electrostatic latent image while the toner layer formed on the toner carrying member comes into contact with the surface of the image bearing member.

BRIEF DESCRIPTION OF THE PREFERRED EMBODIMENTS

Figure 1:
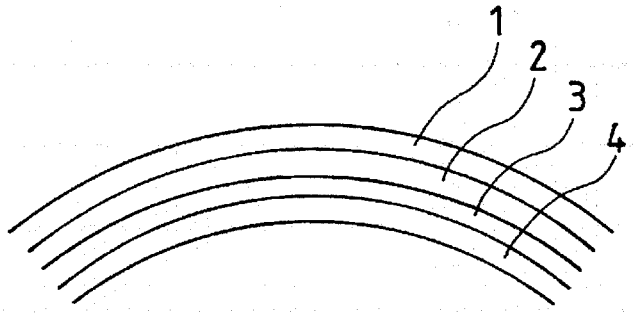
FIG. 1 illustrates a cross section of an image bearing member (a photosensitive member) produced in Production Example 1, which is used as the image bearing member in the present invention.

The present invention utilizes an image bearing member having release properties, whereby the frictional force with the toner of the toner carrying member can be reduced at the time of contact development, the deterioration of the toner can be prevented during long-term service, a high resolution image can be achieved and the surface deterioration of the toner carrying member can be hindered or prevented, even when a toner of small particle diameter is used.

The present invention is effective when the surface of the photosensitive member is mainly composed of a polymeric binder. For example, it is effective when a protective film mainly composed of a resin is provided on an inorganic photosensitive member comprised of selenium, amorphous silicon or the like, and when a functionally separated organic photosensitive member has a surface layer made of a charge transporting material and a resin as a charge transport layer, or when the protective layer as mentioned above is further provided thereon.

As a means for imparting release properties to such a surface layer (i.e., a means for making the surface of an image bearing member have a contact angle with water of at least 90°), it may include (1) employing a resin with a low surface energy for the film, (2) adding an additive capable of imparting water repellency or lipophilic properties, and (3) dispersing a powdery material having high release properties. The means (1) includes introduction of fluorine-containing groups or silicon-containing groups into the resin structure. The means (2) includes addition of a surface active agent. The means (3) includes dispersion of a compound containing fluorine atoms as exemplified by polytetrafluoroethylene, polyvinylidene fluoride or carbon fluoride. In particular, polytetrafluoroethylene is preferred. In the present invention, preferred is means (3) in which a powder with release properties such as fluorine-containing resin powder is dispersed in a polymeric binder.

It is preferable to use any of these methods alone or in combination to make the image bearing member surface have a contact angle with water of at least 90°. If the surface of the image bearing member has a contact angle with water of less than 90°, the surface of the toner carrying member and the toner tend to deteriorate when a lot of copies are taken.

To place such a powder in the surface, a layer comprising a binder resin and the powder dispersed therein may be provided on the outermost surface of the photosensitive member. Alternatively, in the case of the organic photosensitive member mainly composed of a resin, the powder may be dispersed in the outermost layer without forming any additional surface layer. The powder may be added preferably in an amount from 1 to 60% by weight, and more preferably from 2 to 50% by weight, based on the total weight of the surface layer. Its addition in an amount less than 1% by weight is less effective to improve running durability of the toner and the toner carrying member, and that in an amount more than 60% by weight is not preferable since it may cause a decrease in film strength and a decrease in the amount of light entering the photosensitive member.

The present invention is especially effective when its charging, i.e. means is direct charging where a charging member is brought into touch with the photosensitive member. Compared with corona charging where the charging means is not brought into contact with the photosensitive member, the direct charging imposes a greater load on the surface of the photosensitive member and hence the improvement attributable to the present invention can be remarkable in respect of the service life of photosensitive members. Thus, it is one of preferable modes of application.

One of preferred examples of the photosensitive member used in the present invention will be described below.

The photosensitive member may comprise a conductive substrate, a photosensitive layer which may be comprised of a charge generation layer and a charge transport layer and which may also serve as a surface layer, and optionally a protective layer.

As the conductive substrate, a cylinder or film made of a metal such as aluminum or stainless steel; a plastic having a coating layer formed of an aluminum alloy or an indium oxide-tin oxide alloy; a paper or plastic impregnated with conductive particles; and a plastic having a conductive polymer are used.

On such a conductive substrate, a subbing layer may be provided for the purposes of improving adhesion of the photosensitive layer, improving coating properties, protecting the substrate, covering some defects on the substrate, improving charge injection from the substrate and protecting the photosensitive layer from electrical failure. The subbing layer may be formed of any of materials such as polyvinyl alcohol, poly-N-vinyl imidazole, polyethylene oxide, ethyl cellulose, methyl cellulose, nitro cellulose, an ethylene-acrylic acid copolymer, polyvinyl butyral, phenol resin, casein, polyamide, copolymer nylon, glue, gelatin, polyurethane and aluminum oxide. Its layer thickness may usually range from 0.1 to 10 μm, and preferably from 0.1 to 3 μm.

The charge generation layer may be formed by applying a dispersion prepared by dispersing in a binder a charge generating material including organic materials such as azo pigments, phthalocyanine pigments, indigo pigments, perylene pigments, polycyclic quinone pigments, squarilium dyes, pyrylium salts, thiopyrylium salts and triphenylmethane dyes and inorganic materials such as selenium and amorphous silicon, or depositing such organic materials or inorganic materials. The binder may be selected from a vast range of binding resins. For example, they include polycarbonate resins, polyester resins, polyvinyl butyral resins, polystyrene resins, acrylic resins, methacrylic resins, phenol resins, silicone resins, epoxy resins and vinyl acetate resins. The binder contained in the charge generation layer may be in an amount of not more than 80% by weight, and preferably from 0 to 40% by weight. The charge generation layer may have a layer thickness of not larger than 5 μm, and preferably from 0.05 to 2 μm.

The charge transport layer has the function to receive charge carriers from the charge generation layer in the presence of an electric field and transport them. The charge transport layer may be formed by coating a solution prepared by dissolving a charge transporting material in a solvent optionally together with a binder resin. It may have a layer thickness usually of from 5 to 40 μm. The charge transporting material may include polycyclic aromatic compounds having the structure of biphenylene, anthracene, pyrene, phenanthrene or the like in the main chain or side chain; nitrogen-containing cyclic compounds such as indole, carbazole, oxathiazole and pyrazoline; hydrazone compounds, styryl compounds, selenium, selenium-tellurium, amorphous silicon, and cadmium sulfide.

The binder resin in which such a charge transporting material is dispersed may include resins such as polycarbonate resins, polyester resins, polymethacrylate resins, polystyrene resins, acrylic resins and polyamide resins, and organic photoconductive polymers such as poly-N-vinyl carbazole and polyvinyl anthracene.

The protective layer may be formed as the surface layer. The protective layer may be formed from a resin including polyester, polycarbonate, acrylic resins, epoxy resins and phenol resins. Any of these resins may be used alone or in combination of two or more kinds. These resins may also be mixed with a hardening agent.

Electroconductive fine particles may be dispersed in the resin of the protective layer. As examples of the conductive fine particles, they may include metals and metal oxides. They may preferably include ultrafine particles such as zinc oxide, titanium oxide, tin oxide, antimony oxide, indium oxide, bismuth oxide, tin oxide-coated titanium oxide, tin-coated indium oxide, antimony-coated tin oxide and zirconium oxide. Any of these may be used alone or in combination of two or more kinds. In general, when particles are dispersed in the protective layer, the particles may preferably have a smaller particle diameter than the wavelength of incident light in order to prevent the incident light from scattering because of the dispersed particles. The conductive or insulating particles to be dispersed in the protective layer may preferably have a particle diameter of not larger than 0.5 μm. The particles may preferably be contained in the protective layer in an amount of from 2 to 90% by weight, and more preferably from 5 to 80% by weight. The protective layer may preferably have a layer thickness from 0.1 to 10 μm, and more preferably from 1 to 7 μm.

The surface layer can be formed by applying a dispersion of resin by spray coating, beam coating or dip coating.

The process cartridge of the present invention may include a process cartridge employing a system in which a toner as a one-component developer is applied to the surface of an elastic roller and it is brought into contact with the surface of the photosensitive member. The toner may preferably be a non-magnetic toner, or may be a magnetic toner. What is important is that the toner on the elastic roller is brought into contact with the surface of the photosensitive member (the image bearing member). The toner carrying member substantially comes into contact with the surface of the image bearing member. This means that the toner carrying member comes into contact with the image bearing member when the toner is removed from the toner carrying member. Here, in order to obtain toner images free of the edge effect utilizing the electric field acting between the photosensitive member and the elastic roller facing the surface of the photosensitive member, the elastic roller must have a potential in the vicinity of its surface to form an electric field between its surface and the surface of the photosensitive member. For this purpose, the elastic roller is prevented from electrical conduction with the surface of the photosensitive member by controlling the resistance of the elastic rubber to a medium-resistance range, or a thin dielectric layer may be formed on the surface layer of the conductive roller. As another constitution, it is also possible to provide a conductive roller with a conductive resin sleeve where the surface facing the photosensitive member is coated with an insulating material, or with an insulating sleeve having a conductive layer on its surface not facing the photosensitive member.

When the one-component contact development system is employed, the roller that carries the toner may be rotated in the same direction as that of rotation of the photosensitive member, or may be rotated in reverse direction when rotated in the same direction, the toner carrying member may preferably be rotated at a different peripheral speed from that of the photosensitive member, at a peripheral speed ratio of 100% or more, more preferably from 120% to 300%, and still more preferably from 140% to 250% of the speed of the photosensitive member. If it is less than 100%, a problem occurs in image quality, such that the line sharpness is poor. As the peripheral speed ratio increases, the quantity of the toner fed to a developing zone increases and the toner more frequently comes off. On the latent image, where the toner is taken off at unnecessary areas and imparted to necessary areas, this is repeated to obtain a toner image faithful to the latent image.

The toner on the toner carrying member may preferably be carried in a thin layer of not more than two layers of toner particles, and may preferably be carried in a quantity of from 0.4 $D\times\rho$ to 1.1 $D\times\rho$ ($g/m^2$) per unit area, wherein D represents a weight average particle diameter $D_4$ (μm) of the toner and ρ represents a true density ($g/cm^3$) of the toner; which is more preferably from 0.5 $D\times\rho$ to 1.1 $D\times\rho$ ($g/m^2$), and still more preferably from 0.6 $D\times\rho$ to 0.95 $D\times\rho$ ($g/m^2$).

The present invention does not embrace the two-component development system comprising a toner and a magnetic carrier making use of a magnetic brush.

As a cleaning member used in the present invention, a blade, a roller, a fur brush, a magnetic brush or the like may be used. Two or more kinds of these cleaning members may be used in combination.

The toner used in the present invention may preferably comprise toner particles on which surface an inorganic fine powder is present. Such a toner improves development efficiency and latent image reproducibility and decreases fog phenomenon.

The inorganic fine powder used in the present invention may include, for example, colloidal silica, titanium oxide, iron oxide, aluminum oxide, magnesium oxide, calcium titanate, barium titanate, strontium titanate, magnesium titanate, cerium oxide and zirconium oxide. Any of these may be used alone or in the form of a mixture of two or more kinds. Fine powders of oxides such as titania, alumina and silica or fine powders of composite oxides of any of these are preferred.

The toner preferably used in the present invention is a mixture of toner particles with the inorganic fine powder. An organic fine powder or fine resin powder having an average particle diameter smaller than the average particle diameter of the toner particles may be further mixed.

In particular, an inorganic fine powder having a specific surface area, as measured by the BET method using nitrogen absorption, of not less than 30 $m^2/g$ (particularly from 50 to 400 $m^2/g$) can give good results. The inorganic fine powder may be used in an amount of from 0.01 part to 8 parts by weight, and preferably from 0.1 part to 5 parts by weight, based on 100 parts by weight of the toner.

For the purposes of making the powder hydrophobic and controlling chargeability, the inorganic fine powder used in the present invention may optionally have been treated with a treating agent such as silicone varnish, modified silicone varnish of various types, silicone oil, modified silicone oil of various types, a silane coupling agent, a silane coupling agent having a functional group, or other organic silicon compound, or may have been treated in combination of any of these treating agents. In particular, an inorganic fine powder having been treated with silicone oil is preferred in the image forming method including many contacts.

The toner may also preferably be a toner whose volume average particle diameter Dv (μm) is 3 μm≦Dv≦8 μm, weight average particle diameter $D_4$ (μm) is $3.5 \leqq D_4 \leqq 9$ and percentage Nr of particles with diameters not larger than 5 μm in number particle size distribution is 17% by number ≦Nr≦90% by number.

If the particles with diameters not larger than 5 μm are less than 17% by number, the invention may become almost not effective for decreasing the toner consumption. If the volume average particle diameter Dv (μm) of the toner is larger than 8 μm and the weight average particle diameter $D_4$ thereof is larger than 9 μm, the resolution of dots of 100 μm diameter or less may become low. Here, if images are formed forcibly under such conditions, bold line images or black spots around line images tend to occur and also the toner consumption may increase.

When the toner has the above particle size distribution, a high productivity can be maintained also in the production of toners of small particle size. If the toner particles with particle diameters not larger than 5 μm are more than 90% by number, image density may become lower. Preferably the particle size distribution is 60% by number<Nr≦88% by number. With regard to the average particle diameter, in order to improve resolving power more, the toner may preferably be a fine particle size toner of 3.0 μm≦Dv ≦6.0 μm and 3.5 μm≦$D_4$<6.5 μm, and more preferably of 3.2 μm≦Dv≦5.8 μm and 3.6 μm≦$D_4$≦6.3 μm.

In order to reduce the toner consumption and to clearly resolve the isolated dots, the toner preferably satisfies that the volume average particle diameter Dv (μm) is 3 μm≦Dv<6 μm, the weight average particle diameter $D_4$ (μm) is 3.5 μm≦$D_4$<6.5 μm, the percentage by number in number particle size distribution (Nr) of particles with diameters not larger than 5 μis 60%<Nr≦90%, the volume percentage of particles of diameters not smaller than 8 μm in volume particle size distribution is not more than 15%, and Nm/Nv, and the ratio of the percentage by number of particles of diameters not larger than 3.17 μm in number particle size distribution (Nm) to the percentage of the particles of diameters not larger than 3.17 μm in volume particle distribution is from 2.0 to 8.0.

More preferably, Nr of particles with diameters not larger than 5 μm may be 62%<Nr≦88%. With regard to the average particle diameter, in order to more improve resolving power, the Dv and $D_4$ may preferably be 3.2 μm≦Dv≦5.8 μm and 3.6 μm≦$D_4$≦6.3 μm, respectively.

If Nm/Nv is less than 2.0, fog tends to occur, and if it is more than 8, the resolution of isolated dots tends to be poor. The Nm/Nv may more preferably be 3.0 to 7.0. In such an instance, the percentage Nm of particles with diameters not larger than 3.17 μm in number particle size distribution may be from 5% to 40%, and preferably from 7% to 35%.

When the volume ratio of the toner particles of particle diameters not smaller than 8 μm in volume particle size distribution are 10% or less, black spots around line images can be further more decreased, changes in size distribution of particles in the developing assembly can be controlled throughout running, and a stable density can be obtained advantageously.

In the present invention, a higher image quality is achieved by using a toner of the smaller particle diameter, and lower toner consumption is achieved by increasing the quantity of the toner particles having particle diameters not larger than 5 μm of which charge quantity per unit mass is high. By using the image bearing member of which surface has a contact angle with water of at least 90°, transfer performance of toner particles having a fine particle diameter is improved to prevent blank areas caused by poor transfer.

The toner may also preferably have an absolute charge quantity (mC/kg) of $14 \leqq Q \leqq 80$ (Q: quantity of triboelectricity to iron powder), and more preferably $24 \leqq Q \leqq 60$. If Q is less than 14, the charge quantity may become too low to effectively decrease the toner consumption. If Q is more than 80, the charge quantity may become so high that decrease in image density may occur.

In general, more toner participates to develop a line image area than for a solid image area. The reason therefor is presumed as follows: In an electrostatic latent line image on the image bearing member, the lines of electric force densely go around from the outside to inside of the latent line image, so that the force to attract and press the toner on the latent image face is greater at the line image area that at the solid image area.

The reason why the toner used in the present invention can develop the line image with a smaller quantity than conventional toners and save toner consumption is presumed as follows: In the one-component development system, the toner participates in development in a somewhat agglomerated state on the surface of the image bearing member. Since the toner used in the present invention contains a larger quantity of particles with diameters not larger than 5 μm having a high charge quantity per unit mass, it can fill up the latent image potential with ease, and surplus particles attracted to the line image area on the image bearing member can return to the surface of the sleeve (toner carrying member) against the force of the electric lines going into the latent image, so that only a proper quantity of the toner remains on the line image area. Since the particles with diameters not larger than 5 μm have a high charge quantity per unit mass, a small amount of them can weaken the developing electric field, and surplus particles are not strongly affected by the electric lines around the latent image. In the case of solid images also, the toner having a smaller particle diameter can achieve high image density with a small quantity and can reduce the toner consumption.

As binder resins used in the toner, they may include polystyrene; styrene derivatives such as poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. A cross-linked styrene resin is one of preferred binder resins.

Co-monomers co-polymerizable with styrene monomers in the styrene copolymers may include vinyl monomers such as monocarboxylic acids having a double bond and derivatives thereof as exemplified by acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof as exemplified by maleic acid, butyl maleate, methyl maleate and dimethyl maleate; vinyl esters as exemplified by vinyl chloride, vinyl acetate and vinyl benzoate; olefins as exemplified by ethylene, propylene and butylene; vinyl ketones as exemplified by methyl vinyl ketone and hexyl vinyl ketone; and vinyl ethers as exemplified by methyl vinyl ether, ethyl vinyl ether and isobutyl vinyl ether; any of which may be used alone or in combination. As a cross-linking agent, compounds having at least two polymerizable double bonds may be used, which may include aromatic divinyl compounds as exemplified by divinyl benzene and divinyl naphthalene; carboxylic acid esters having two double bonds as exemplified by ethylene glycol diacrylate, ethylene glycol dimethacrylate and 1,3-butanediol dimethacrylate; divinyl compounds as exemplified by divinyl aniline, divinyl ether, divinyl sulfide and divinyl sulfone; and compounds having at least three vinyl groups; any of which may be used alone or in the form of a mixture.

As binder resins for toners used in pressure fixing, they may include low-molecular weight polyethylene, low-molecular weight polypropylene, an ethylene-vinyl acetate copolymer, an ethylene-acrylate copolymer, higher fatty acids, polyamide resins and polyester resins. These may preferably be used alone or in combination.

To improve the releasability from fixing members at the time of fixing and the fixing performance, it is preferable to incorporate any of the following waxes in the toner. They may include paraffin wax and derivatives thereof, microcrystalline wax and derivatives thereof, Fischer-Tropsch wax and derivatives thereof, polyolefin wax and derivatives thereof, and carnauba wax and derivatives thereof. The derivatives may include oxides, block copolymers with vinyl monomers, and graft modified products.

Besides, the waxes may further include alcohols, fatty acids, acid amides, esters, ketones, hardened caster oil and derivatives thereof, vegetable waxes, animal waxes, mineral waxes and petrolactum.

As colorants, conventionally known inorganic or organic dyes and pigments are used. For example, carbon black, aniline black, acetylene black, naphthol yellow, hanza yellow, rhodamine lake, alizarine lake, red iron oxide, phthalocyanine blue and indanthrene blue. Usually, any of these may be used in an amount of from 0.5 part to 20 parts by weight.

A magnetic material may be mixed in the toner particles used in the present invention. The magnetic material may include metal oxides containing elements such as iron, cobalt, nickel, copper, magnesium, manganese, aluminum and silicon. In particular, those mainly composed of a magnetic oxide such as triiron tetraoxide or γ-iron oxide are preferred.

For the purpose of charge control, nigrosine dyes, quaternary ammonium salts, salicylic acid metal complexes or metal salts, acetylacetone or the like may be used.

In the toner used in the present invention, other additives may also be used so long as they do substantially not adversely affect the toner. For example, a lubricant powder such as Teflon powder, stearic acid zinc powder or vinylidene polyfluoride powder; an abrasive such as cerium oxide powder, silicon carbide powder or strontium titanate powder; a fluidity-providing agent as exemplified by titanium oxide powder or aluminum oxide powder; an anti-caking agent; and a conductivity-providing agent as exemplified by carbon black powder, zinc oxide powder or tin oxide powder may be used, and also reverse-polarity organic particles and inorganic particles may be used in a small amount as a developing improving agent.

The toner used in the present invention can be produced by using known methods. For example, the toner used in the present invention can be obtained by thoroughly mixing a binder resin, a wax, a metal salt or metal complex, a pigment or dye as a colorant, or a magnetic material, optionally a charge control agent and other additives by means of a mixing machine such as a Henschel mixer or a ball mill, thereafter melt-kneading the mixture using a heat kneading machine such as a heat roll, a kneader or an extruder to make resins melt together, dispersing or dissolving a metal compound, a pigment or dye and a magnetic material in the molten product, and solidifying it by cooling, followed by pulverization and classification. In the step of classification, a multi-division classifier may preferably be used in view of production efficiency.

The average particle diameter and particle size distribution of the toner can be measured by various methods using a Coulter counter Model TA-II or Coulter Multisizer (manufactured by Coulter Electronics, Inc.). In the present invention, they are measured using Coulter Multisizer. An interface (manufactured by Nikkaki k.k.). that outputs number distribution and volume distribution and a personal computer PC9801 (manufactured by NEC.) are connected to it. As an electrolytic solution, an aqueous 1% NaCl solution is prepared using first-grade sodium chloride. For example, ISOTON R-II (Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution containing the sample is treated for about 1–3 minutes in an ultrasonic dispersion machine for dispersion. The volume and number of toner particles of diameters of not smaller than 2 μm were measured by means of the above Coulter Multisizer with an aperture of 100 μm, to calculate the volume distribution and number distribution. Then the volume-based, volume average particle diameter (Dv: the middle value of each channel is used as the representative value for each channel) and weight average particle diameter ($D_4$) which are determined from volume distribution. The number-based, length average particle diameter ($D_1$) determined from number distribution, and the volume based particle ratios (8.00 μm or larger and 3.17 μm or smaller) are determined from the volume distribution and the number based, particle ratios (5 μm or smaller and 3.17 μm or smaller) determined from the number distribution. These values relate to the present invention.

Figure 8:
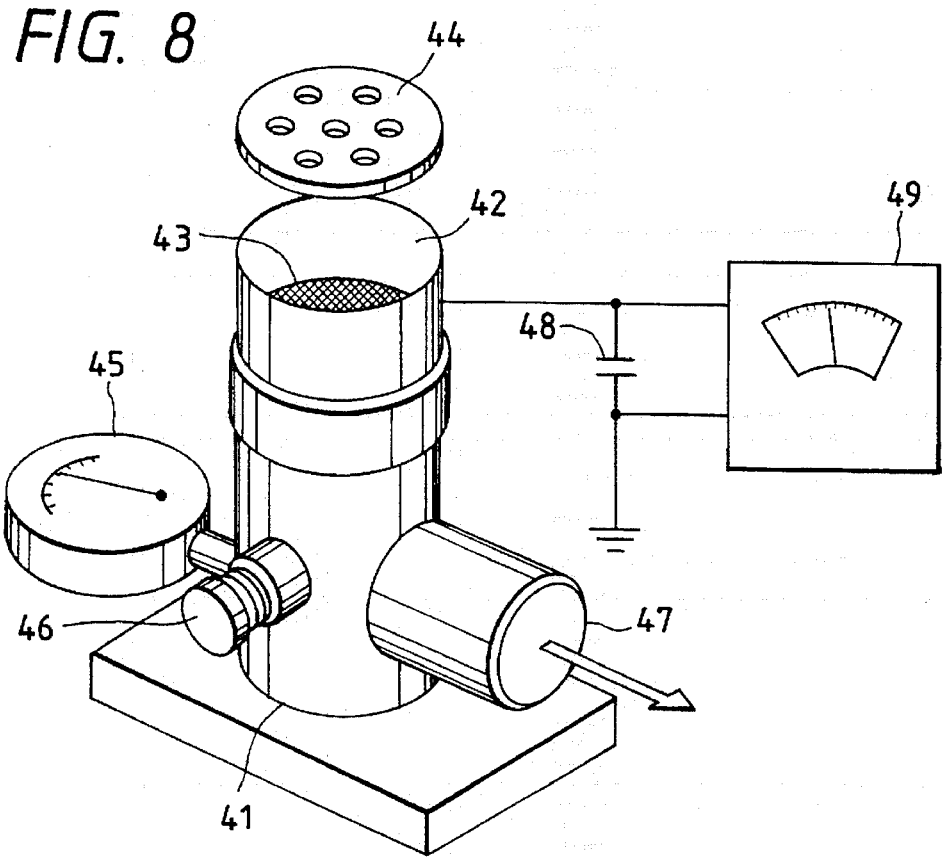
FIG. 8 illustrates a measuring device to measure the quantity of triboelectricity of powdery samples.

A method of measuring the quantity of triboelectricity to iron powder, of the toner used in the present invention will be described with reference to FIG. 8.

In an environment of 23° C. and relative humidity 60% and using an iron powder EFV200/300 (available from Powder Teck Co.) as a carrier, a mixture of 1.0 g of the toner and 9.0 g of the carrier is put in a 50 to 100 ml bottle made of polyethylene, and manually shaken 50 times. An aliquot 1.0–1.2 g of the resulting mixture is put in a measuring container 42 made of a metal at the bottom of which a conductive screen 43 of 500 mesh is provided, and the container is covered with a plate 44 made of a metal. The total weight of the measuring container 42 at this time is weighed and is expressed as W1 (g). Next, in a suction device 41 (made of an insulating material at least at the part coming into contact with the measuring container 42), air is sucked from a suction opening 47 and an air-flow control valve 46 is operated to control the pressure indicated by a vacuum indicator 45 to be 2,450 hPa (250 mmAq). In this state, suction is carried out for 1 minute to remove the toner by suction. The potential indicated by a potentiometer 49 at this time is expressed as V (volt). Herein, the numeral 48 denotes a capacitor, whose capacitance is expressed as C (μF). The total weight of the measuring container after completion of the suction is also weighed and is expressed as W2 (g). The quantity of triboelectricity (mC/kg) of the toner is calculated as shown by the following expression.

Quantity of triboelectricity (mC/kg)=CV/(W1–W2)

Figure 3:
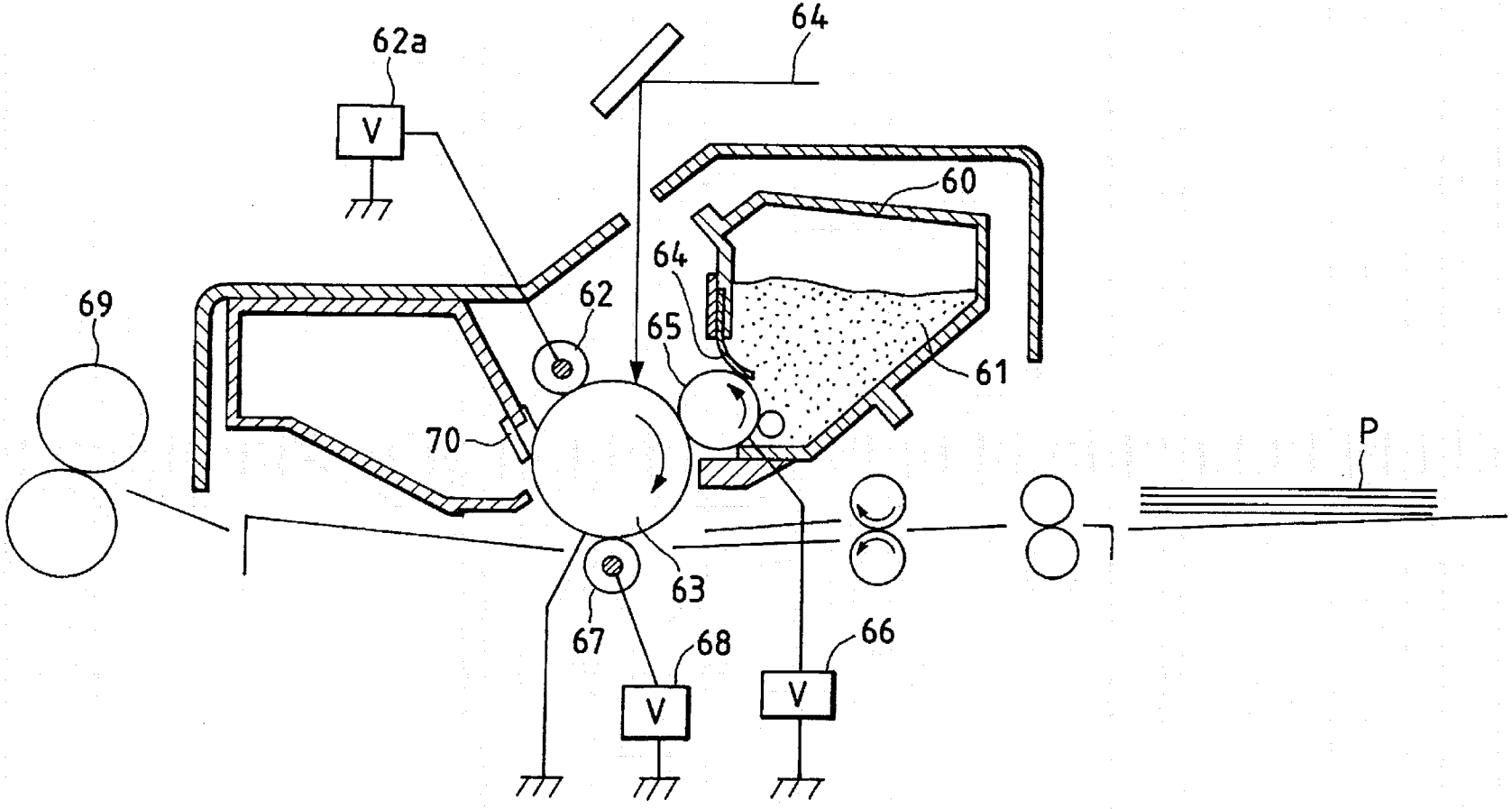
FIG. 3 illustrates an example of the image forming method of the present invention.

The image forming method of the present invention will be described below with reference to FIG. 3. As an example of copying machines or printers for carrying out the image forming method of the present invention, an electrophotographic apparatus as shown in FIG. 3 is available. In a developing means 60, a toner 61 used in the present invention is held. The toner is a magnetic toner or a non-magnetic toner.

The surface of a photosensitive member 63 (e.g., an OPC photosensitive drum or an amorphous silicon or polycrystalline photosensitive drum) is charged by a contact charging means (e.g., a charging roller, a charging brush or a charging blade) 62 to which a voltage has been applied by a bias applying means 62*a*, followed by exposure to light (e.g., laser light or halogen lamp light) 64 to form an electrostatic latent image on the photosensitive member 63. The electrostatic latent image is developed with the toner 61 held in the developing means 60 provided with a toner coating blade (e.g., an elastic blade or a metal blade) 64 and a developing roller 65 having on its surface an elastic layer or dielectric layer with a medium resistance of $10^3$ to $10^9$ Ω.cm. Thus a toner image is formed. The development is carried out by a regular development system or a reverse development system. In the developing zone, a direct bias or alternating bias is optionally applied to the developing roller 65 through a bits applying means 66. A transfer medium P is transported to a transfer zone, whereupon the medium is charged by a transfer means (e.g., a transfer roller or a transfer belt) 67 to which a voltage has been applied by a bias applying means 68 while pressing the transfer medium P from its side opposite to the photosensitive member 63, so that the toner image on the surface of the photosensitive member 63 is electrostatically transferred to the transfer medium P. As occasion calls, the toner image on the photosensitive member 63 may be once transferred to an intermediate transfer medium (not shown; e.g., an intermediate transfer drum or an intermediate transfer belt) and then the toner image may be transferred from the intermediate transfer medium to the transfer medium P.

The toner image on the transfer medium P having been separated from the photosensitive member 63 is fixed on the transfer medium P by a heat pressure means (e.g., heat pressure roller fixing means) 69. The toner remaining on the photosensitive member 63 after the step of transfer is optionally removed from the surface of the photosensitive member 63 by a cleaning means (e.g., a cleaning blade, a cleaning roller or a cleaning brush) 70. The photosensitive member 63 having been thus cleaned is again charged by the charging means 62, where the steps starting from the charging step are repeated.

Figure 4:
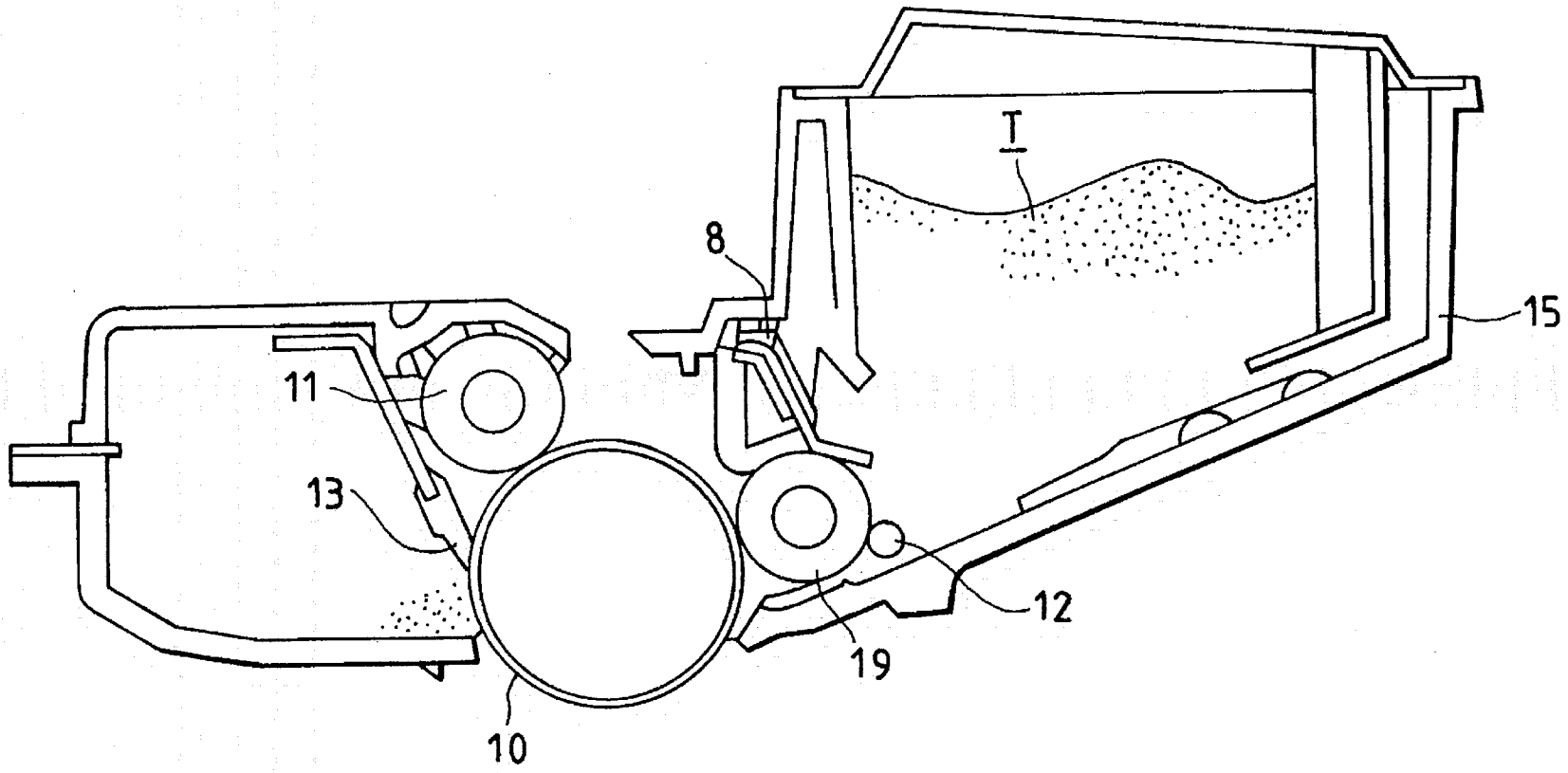
FIG. 4 illustrates an example of the process cartridge of the present invention.

FIG. 4 schematically illustrates a cross section of an example of a process cartridge taken out of the main body of an image forming apparatus. The process cartridge has at least a developing means and an electrostatic image bearing member which are held into one unit as a cartridge, and the process cartridge is set up as to be detachable from the main body of an image forming apparatus (e.g., a copying machine or a laser beam printer). In the process cartridge shown in FIG. 4, a developing roller (elastic roller) 19 is provided in a developing assembly 15 in the manner that it is pressed against a photosensitive drum 10 to form a nip between them. The developing roller 19 is provided with a coating blade 8 and a coating roller 12 in pressure contact. A charging roller 11 and a cleaning blade 13 are also provided on the photosensitive drum 10 in pressure contact.

In the image forming method of the present invention, the photosensitive member and the toner carrying member come into contact with each other through the toner, where any one of the photosensitive member and the toner carrying member may preferably be an elastic member or a flexible belt or tube. For example, combinations of a photosensitive drum with a developing elastic roller, a photosensitive belt with a developing flexible tube, and a photosensitive drum with an elastic belt.

Figure 5:
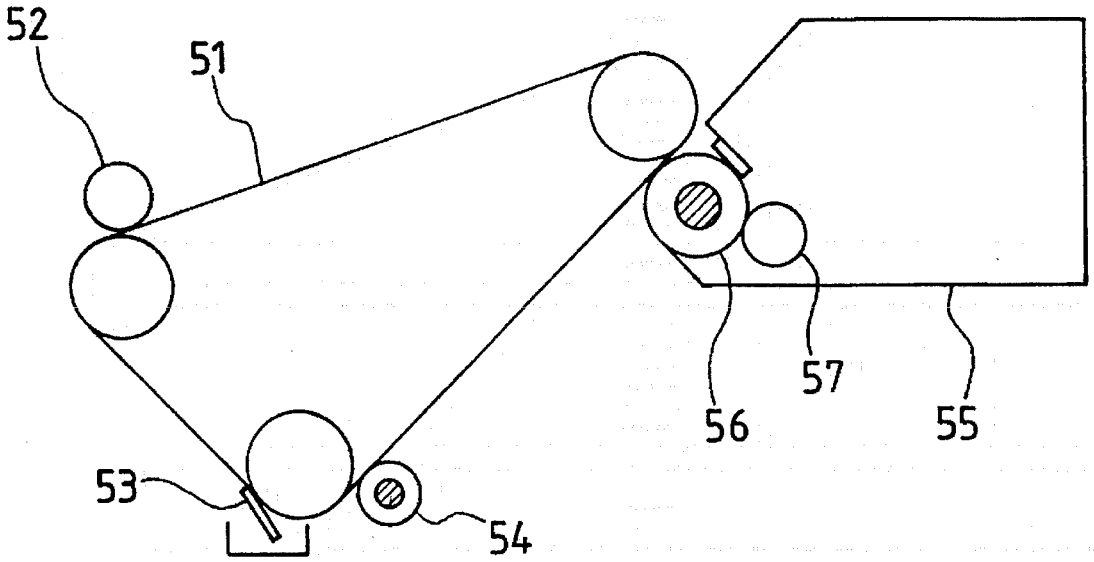
FIG. 5 illustrates an example of the image forming method of the present invention in which a photosensitive belt is used.

FIG. 5 shows an example of the process cartridge comprising a photosensitive belt 51, a transfer roller 52, a cleaning blade 53, a charging roller 54, a developing assembly 55 comprising a developing roller 56, and a coating roller 57.

The present invention will be further described below by giving Examples. The present invention is by no means limited to these.

Image Bearing Member Production Example 1

To produce an image bearing member, a cylinder of 30 mm diameter and 254 mm long made of aluminum was used as a substrate. On this substrate, layers with configuration as shown in FIG. 1 were successively formed layer-by-layer by dip coating. Thus, an image bearing member photosensitive drum No. 1 was produced.

(1) Conductive coating layer 4: Mainly composed of powders of tin oxide and titanium oxide dispersed in a phenol resin. Layer thickness: 15 μm.

(2) Subbing layer 3: Mainly composed of a modified nylon and a copolymer nylon. Layer thickness: 0.6 μm.

(3) Charge generation layer 2: Mainly composed of an azo pigment having absorption in long wavelength range, dispersed in butyral resin. Layer thickness: 0.6 μm.

(4) Charge transport layer 1: Mainly composed of a hole-transporting triphenylamine compound dissolved in a weight ratio of 8:10 in a 8:2 resin mixture, in weight ratio, of a polycarbonate resin (molecular weight: 40,000 as measured by an Ostwald viscometer) and fluorine-modified polycarbonate resin (molecular weight: 20,000, containing in the skeleton bisphenol-A of which central methyl group is substituted by fluorine), to which polytetrafluoroethylene powder was further added in an amount of 10% by weight based on the total solid content and uniformly dispersed. Layer thickness: 20 μm. Contact angle with water: 97°.

Figure 6:
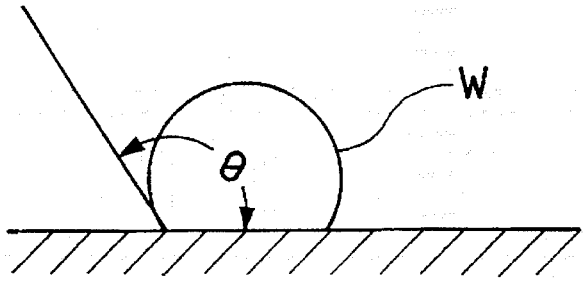
FIG. 6 is an illustration concerning a contact angle θ with water.

To measure the contact angle θ with water of the photosensitive drum surface, pure water and a contact angle meter Model CA-DS, manufactured by Kyowa Kaimen Kagaku K.K. An illustration concerning the contact angle θ is given in FIG. 6 in which W represents water.

Image Bearing Member Production Example 2

(Comparative Example)

The procedure of Production Example 1 was repeated to produce a photosensitive drum No. 2, except that no polytetrafluoroethylene powder was added. The contact angle with water was 81°.

Image Bearing Member Production Example 3

A photosensitive drum No. 3 was produced in the same manner as in Production Example 1 up to the formation of the charge generation layer. The charge transport layer was formed using a solution prepared by dissolving a hole-transporting triphenylamine compound in a polycarbonate resin (molecular Weight: 20,000 as measured by an Ostwald viscometer) in a weight ratio of 10:10, and coating the solution in a layer thickness of 20 μm. To further form a protective layer thereon, a composition prepared by dissolving a hole-transporting triphenylamine compound in a polycarbonate resin (molecular weight: 80,000 as measured by an Ostwald viscometer) in a weight ratio of 5:10 and in which polytetrafluoroethylene powder was added in an amount of 30% by weight based on the total solid content and uniformly dispersed, was applied onto the charge transport layer by spray coating to a layer thickness of 3 μm. The contact angle with water was 101°.

Toner Preparation Example A

| | (by weight) |
|---|---|
| Styrene-acrylate resin (binder resin) | 100 parts |
| Metal complex salt of azo pigment (negative charge control agent) | 2 parts |
| Carbon black (colorant) | 6 parts |
| Low-molecular weight propylene/ethylene copolymer (anti-offset agent) | 4 parts |

The above materials were mixed by dry process, and thereafter kneaded by means of a twin-screw extruder set at 130° C. She kneaded product was cooled and then finely pulverized using an air pulverizer, followed by classification by means of a multi-division classifier to obtain negatively chargeable non-magnetic toner particles of which weight average particle diameter was 5.2 μm with an adjusted particle size distribution. To this toner particles, 1.5% by weight of negatively chargeable hydrophobic fine silica particles (BET specific surface area: 200 $m^2/g$), having been treated with silicone oil, was externally added. Toner thus obtained was used as toner A.

The particle size distribution of the toner A is shown in Table 1.

Toner Preparation Example B

To toner particles prepared in the same manner as in Toner Preparation Example A, 1.0% by weight of negatively chargeable hydrophobic fine silica particles (BET specific surface area: 250 $m^2/g$) treated with silicone oil was externally added to obtain toner B of a weight average particle diameter 5.2 μm.

The particle size distribution of the toner B is show in Table 1.

Toner Preparation Examples C to F

| | |
|---|---|
| Styrene-acrylate resin | 100 parts |
| Metal complex salt of azo pigment | 2 parts |
| Carbon black | 6 parts |
| Low-molecular weight propylene/ethylene copolymer | 4 parts |

The above materials were mixed by dry process, and thereafter kneaded by means of a twin-screw extruder set at 130° C. The kneaded product obtained was cooled and then finely pulverized using an air pulverizer, followed by air classification to obtain toner particles of a weight average particle diameter 4.0 μm, 5.0 μm, 6.8 μm or 9.8 μm with an adjusted particle size distribution as shown in Table 1. To this product toner particles, 1.5% by weight of a negatively chargeable hydrophobic fine silica particles (BET specific surface area: 200 $m^2/g$), having been treated with silicone oil, was externally added. Toners thus obtained were used as toners C, D, E and F.

Toner Preparation Example G

To the same toner particles as those of Toner Preparation Example A, 1.0% by weight of hydrophobic fine silica particles (BET specific surface area: 200 $m^2/g$) and 0.2% by weight of hydrophobic fine titania particles (BET specific surface area: 100 $m^2/g$) were externally added to obtain toner G of a weight average particle diameter 5.2 μm with an adjusted particle size distribution as shown in Table 1.

Toner Preparation Example H

To the same toner particles as those of Toner Preparation Example A, 1.0% by weight of hydrophobic fine silica particles (BET specific surface area: 200 $m^2/g$) and 0.2% by weight of hydrophobic fine alumina particles (BET specific surface area: 100 $m^2/g$) were externally added to obtain toner H of a weight average particle diameter 5.2 μm with a particle size distribution as shown in Table 1.

Toner Preparation Example I

| | |
|---|---|
| Polyester resin | 100 parts |
| Magnetite | 30 part |
| Metal complex salt of azo pigment | 2 parts |
| Carbon black | 6 parts |
| Low-molecular weight propylene/ethylene copolymer | 4 parts |

The above materials were mixed by dry process, and thereafter kneaded by means of a twin-screw extruder set at 130° C. The kneaded product obtained was cooled and then finely pulverized using an air pulverizer, followed by air classification to obtain toner particles of a weight average particle diameter 5.5 μm with an adjusted particle size distribution as shown in Table 1. To this toner particles, 1.5% by weight of hydrophobic fine silica particles (BET specific surface area: 200 $m^2/g$), having been treated with silicone oil, was externally added. Toner thus obtained was used as toner I.

Properties of the above toners A to I are also shown in Table 1.

EXAMPLE 1

Figure 2:
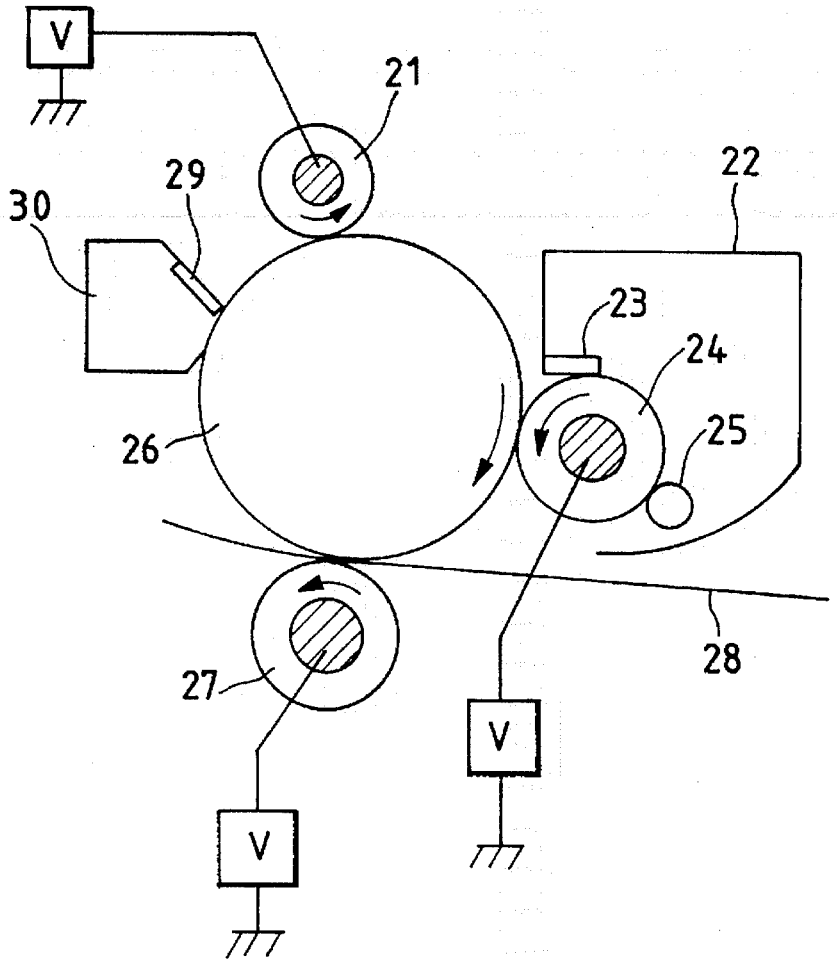
FIG. 2 schematically illustrates an example of an electrophotographic process used in the present invention.

As an electrophotographic apparatus, a 600 dpi laser beam printer (trade name: LBP-8 Mark IV, manufactured by Canon Inc.) was modified so as to operate at a process speed of 24 mm/sec (peripheral speed of the toner carrying member was variable) and to print on 4 sheets of LTR size paper per minute. The apparatus used was as schematically shown in FIG. 2. This apparatus makes use of a charging roller 21 to uniformly charge an image bearing member 26 (a photosensitive drum of 30 mm diameter). After thus charged, an electrostatic latent image was formed by exposing the image area to the laser light, which is then converted into a visible image (a toner image) by the toner, and thereafter the toner image is transferred to a transfer medium 28 by means of a transfer roller 27.

A developing assembly 22 in the process cartridge was modified in the following way. An aluminum sleeve internally provided with a magnet, which serves as a toner feed member, was replaced with a medium-resistance rubber roller (diameter: 16 mm; mandrel diameter: 6 mm) made of a urethane foam and having an electrical resistivity of $10^5$ Ω.cm, which was used as a toner carrying member 24 and was brought into touch with the photosensitive drum 26 so as to form a nip of about 3 mm. The toner carrying member was driven to rotate in the same direction at the contact area with the image bearing member and at a peripheral speed of 200% with respect to the rotational peripheral speed of the image bearing member. The peripheral speed of the toner carrying member was 48 mm/sec, and that of the image bearing member, 24 mm/sec.

As a means for coating the toner on the toner carrying member 24, a coating roller 25 was provided inside the developer container of the developing assembly 22 and was brought into touch with the toner carrying member. The toner was applied to the toner carrying member by rotating the coating roller 25 in the direction opposite to the rotating direction of the toner carrying member at the contact portion. In order to control the coat layer thickness of the toner on the toner carrying member, a blade 23 made of stainless steel, coated with a resin, was attached. As a cleaning member, a blade 29 was provided in a cleaning assembly 30.

Photosensitive drum No. 1 was used as the image bearing member 26, toner A as the toner, and process conditions were set to satisfy the following developing conditions.

TABLE 1

| Toner: | Weight average particle diameter $D_4$ (ρm) | Volume average particle diameter Dv (μm) | Particle diameters: 5 μm or smaller Nr (no. %) | 3.17 μm or smaller Nm (no. %) | 3.17 μm or smaller Nv (vol. %) | 3.17 μm or smaller Nm/Nv | 8 μm or larger (vol. %) | True density (g/cm³) | Quantity of triboelectricity (μC/g) |
|---|---|---|---|---|---|---|---|---|---|
| A | 5.2 | 4.4 | 80 | 15 | 2.9 | 5.17 | 2 | 1.05 | −48 |
| B | 5.2 | 4.5 | 65 | 17 | 3.3 | 5.15 | ≦1 | 1.05 | −44 |
| C | 4.0 | 3.5 | 87 | 25 | 6.7 | 3.73 | ≦1 | 1.05 | −55 |
| D | 5.0 | 4.2 | 84 | 23 | 5.7 | 4.04 | 1 | 1.05 | −50 |
| E | 6.8 | 6.4 | 42 | 8 | 0.8 | 10.00 | 20 | 1.05 | −30 |
| F | 9.8 | 9.2 | 12 | 4 | 0 | Infinite | 72 | 1.05 | −22 |
| G | 5.2 | 4.4 | 80 | 18 | 4.1 | 4.39 | 3 | 1.05 | −42 |
| H | 5.2 | 4.4 | 82 | 18 | 4.2 | 4.29 | 2 | 1.05 | −40 |
| I | 5.5 | 4.8 | 75 | 23 | 4.4 | 5.23 | 3 | 1.25 | −42 |

| | |
|---|---|
| Image bearing member dark area potential: | −700 V |
| Image bearing member light area potential: | −150 V |
| Development bias: | −450 V (DC component only) |

Supplying the toner, continuous image reproduction on 10,000 sheets was carried out to evaluate the resulting images. The toner images had a high image density and were free from fog, showing good results. The same image quality as the initial stage was obtained after the running. At this point, the surface layer of the photosensitive drum was 18 μm thick, and little deterioration was observed for both the photosensitive drum and the toner carrying member unnecessiating replacement of them with new ones.

In the present invention, evaluation of black spots around the line images is carried out with the fine curved lines relating to the quality of graphic images. The lines were one-dot lines which tend to have more black spots around them than the letter line images do.

Figure 7:
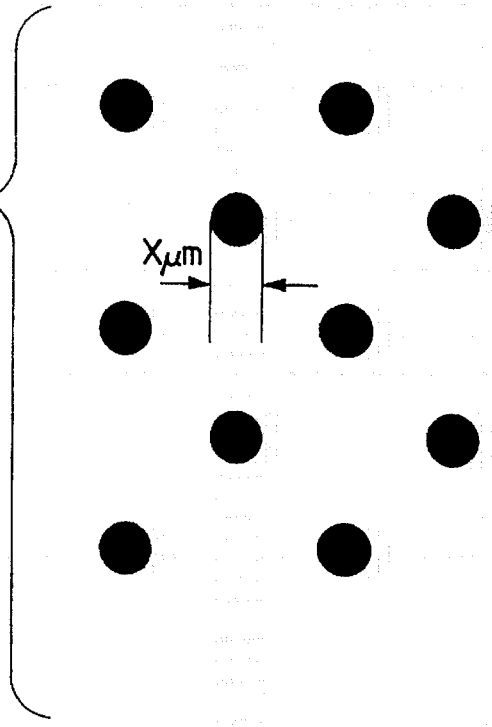
FIG. 7 illustrates a round-spot pattern for evaluating resolution.

Resolution was evaluated by reproducibility of small-diameter isolated dots as shown in FIG. 7. Such dots are difficult to reproduce since the electric fields tend to close because of latent image electric fields.

Fog was measured using a reflection densitometer REFLECTOMETER MODEL TC-6DS (manufactured by Tokyo Denshoku Co., Ltd.) (the worst value of reflection density at white ground areas of paper after printing was represented by Ds, and an average value of reflection densities on the paper before printing as Dr, and a fog value Ds-Dr represents fog quantity). Images with fogging of 2% or less are substantially fog-free good images, and those with fog value of more than 5% are blurred images with conspicuous fog.

Toner consumption was evaluated as follows. A letter pattern printed in an area percentage of 4% was continuously printed out on A4-size paper for 1,000–2,000 sheets, and the toner consumption was determined from the change in toner quantity in the developing assembly. It was 0.025 g/sheet. Also, a latent image of 600 dpi 10-dot vertical line at intervals of 1 cm (line width: about 420 μm) were drawn on the electrostatic latent image bearing member by laser exposure. The latent images were developed, transferred to an OHP sheet made of PET, and then fixed. Vertical line pattern images thus obtained were analyzed using a surface profile analyzer SURFCOADER SE-30H (manufactured by Kosaka Kenkyusho Co.) to determine the manner of toner laid on the vertical lines as a profile of surface roughness, and the line width was determined from the profile. As a result, The line width was 430 μm and lines had been reproduced with high density and high sharpness. It was confirmed that lower toner consumption was achieved while maintaining the latent image reproducibility.

Results of evaluation are shown in Table 2.

EXAMPLE 2

The procedure of Example 1 was repeated except the following.

The toner carrying member was driven so as to rotate in the same direction as the image bearing member at the contact position and at a peripheral speed of 250% of the rotational peripheral speed of the image bearing member. The peripheral speed of the toner carrying member was 60 mm/sec, and that of the image bearing member, 24 mm/sec.

Photosensitive drum No. 3 and toner B were used, and process conditions were so set as to satisfy the following developing condition.

| | |
|---|---|
| Development bias: | −350 V (DE component only) |

Supplying the toner, running on 10,000 sheets was tested to evaluate the images. The images formed had a high image density and caused less fog, showing good results. The same image quality as that of initial stage was obtained after the running. At this point, the surface layer (protective layer) of the photosensitive drum was 2 μm thick, and both the photosensitive drum and the developing roller (toner carrying member) were hardly deteriorated, and did not require replacement.

Results of evaluation are shown in Table 2.

EXAMPLE 3

The procedure of Example 1 was repeated except the following.

The toner carrying member was rotated in the same direction as the image bearing member at the contact point of them and at a peripheral speed of 150% of the rotational peripheral speed of the image bearing member.

Photosensitive drum No. 3 and toner I were used, and process conditions were set to satisfy the following developing condition.

| | |
|---|---|
| Development bias: | −500 V (DC component only) |

Supplying the toner, running on 10,000 sheets was tested to evaluate the images. The images formed had a high image density and caused less fog, showing good results. The same image quality as that of the initial stage was obtained after the running. At this point, the surface layer (protective layer) of the photosensitive drum was 2 μm thick, and both the photosensitive drum and the developing roller (toner carrying member) were hardly deteriorated, and did not require replacement.

Results of evaluation are shown in Table 2.

EXAMPLES 4 TO 6

The procedure of Example 1 was repeated except that toner C, D or E was used. When the toner E was used, the reproduction of latent images of about 50 μm diameter was slightly poor and the toner consumption was slightly larger, but good images were obtained throughout the running as in the Example 1.

Results of evaluation are shown in Table 2.

EXAMPLES 7 AND 8

The procedure of Example 1 was repeated except that toner G or H was used. Image density was slightly low, but the obtained images were practically acceptable.

Results of evaluation are shown in Table 2.

Comparative Example 1

Tests were made in the same manner as in Example 1 except that photosensitive drum No. 2 was used.

Process conditions were set to satisfy the following developing condition.

| Development bias: | −450 V (DC component only) |
|---|---|

On the 6,000th sheet running, granular fog occurred on some area of the toner images at an interval according to the rotation of the photosensitive drum. The cause thereof was faulty charging due to scraping of the image bearing member. At this stage, the layer thickness of the surface layer had decreased to 12 μm or less. When the photosensitive drum was renewed, the granular fog disappeared, but the image density was not restored to the initial level.

After the running test on 10,000 sheets was completed, a new developing roller was assembled to examine the image density. As a result, the image density was restored to the initial level. The image density was also checked for the combination of a fresh toner and the developing roller used for 10,000 sheet running. The image density was 1.30 and not restored to the initial level.

Results obtained are shown in Table 2.

Comparative Example 2

Tests were made in the same manner as in Example 1 except that toner F and photosensitive drum No. 2 were used.

Process conditions were so set as to satisfy the following developing condition.

| Development bias: | −350 V (DC component only) |
|---|---|

On the 7,000th sheet running, granular fog occurred on some area of the toner images at an interval according to the rotation of the photosensitive drum. The cause thereof was faulty charging due to scraping of the image bearing member. At this stage, the layer thickness of the surface layer had decreased to 11 μm or less. When the photosensitive drum was renewed, the granular fog disappeared, but the image density was not restored to the initial level. The running was subsequently continued up to 10,000 sheet running.

After the running test on 10,000 sheets was completed, a new developing roller and a new photosensitive layer were assembled to examine the image density. As a result, the image density was restored to the initial level. The image density was also checked for the combination of a fresh toner and the developing roller used for 10,000 sheets. The image density was 1.28 and not restored to the initial level.

Results obtained are shown in Table 2.

TABLE 2

| Image bearing member | Toner quantity on toner carrying member M/S (g/m²) | Image density of 5 mm square solid black: Initial | After 10,000 sheets | After 1,000 sh. toner changed | Black spots around 100 μm line images | Resolution: 50 μm dots | Resolution: 100 μm dots | Toner consumption (g/sheet) | Ten-dot line width (μm) | Fog due to drum scrape |
|---|---|---|---|---|---|---|---|---|---|---|
| Example: | | | | | | | | | | |
| 1 No. 1 | 40 | 1.46 | 1.44 | 1.46 | A | A | A | 0.025 | 430 | None |
| 2 No. 3 | 40 | 1.46 | 1.43 | 1.45 | A | A | A | 0.028 | 430 | None |
| 3 No. 3 | 50 | 1.48 | 1.44 | 1.45 | A | A | A | 0.033 | 430 | None |
| 4 No. 3 | 40 | 1.40 | 1.37 | 1.39 | A | A | A | 0.027 | 420 | None |
| 5 No. 3 | 40 | 1.45 | 1.40 | 1.41 | A | A | A | 0.027 | 430 | None |
| 6 No. 3 | 50 | 1.47 | 1.45 | 1.45 | B | B | A | 0.032 | 440 | None |
| 7 No. 3 | 30 | 1.40 | 1.38 | 1.38 | A | A–B | A | 0.024 | 410 | None |
| 8 No. 3 | 30 | 1.39 | 1.37 | 1.37 | A | A–B | A | 0.024 | 410 | None |
| Comparative Example: | | | | | | | | | | |
| 1 No. 2 | 40 | 1.45 | 1.30 | 1.31 | A | A | A | 0.028 | 430 | 6,000th* sheet |
| 2 No. 2 | 100 | 1.49 | 1.28 | 1.30 | C | C | B–C | 0.035 | 460 | 7,000th* sheet |

(Remarks)
*Occurred on
Evaluation of black spots around line images and resolution:
A: Very good; B: Good; C: Conspicuous black spots Toner Preparation Example 1

| | |
|---|---|
| Polyester resin | 88 wt. % |
| Metal complex salt of salicylic acid derivative | 2 wt. % |
| Carbon black | 6 wt. % |
| Polyolefin | 4 wt. % |

The above materials were mixed by dry process, and thereafter kneaded by means of a twin-screw extruder set at 140° C. The kneaded product obtained was cooled and then finely pulverized using an air pulverizer, followed by classification by means of a multi-division classifier to obtain a negatively chargeable non-magnetic toner of a weight average particle diameter 8.0 μm with an adjusted particle size distribution as shown in Table 3. This was used as toner No. 1 (a product without external addition).

Toner Preparation Example 2

To the toner of Toner Preparation Example 1, 1.5% by weight of hydrophobic fine silica particles (BET specific surface area: 200 m²/g) was externally added to obtain a negatively chargeable non-magnetic toner, No. 2, with a weight average particle diameter of 8.0 μm.

Toner Preparation Example 3

| | |
|---|---|
| Styrene-acrylate resin | 88 wt. % |
| Metal-containing azo pigment | 2 wt. % |
| Carbon black | 6 wt. % |
| Polyolefin | 4 wt. % |

The above materials were mixed by dry process, and thereafter kneaded by means of a twin-screw extruder set at 140° C. The kneaded product obtained was cooled and then finely pulverized using an air pulverizer, followed by air classification to obtain a negatively chargeable non-magnetic toner of a weight average particle diameter 7.0 μm with an adjusted particle size distribution as shown in Table 3. This was used as toner No. 3.

Toner Preparation Example 4

To the toner of Toner Preparation Example 3, 1.6% by weight of hydrophobic fine silica particles (BET specific surface area: 250 $m^2/g$) was externally added to obtain a negatively chargeable non-magnetic toner, No. 4, with a weight average particle diameter of 7.0 μm.

Physical properties of the toners Nos. 1 to 4 are shown in Table 3.

TABLE 3

| Toner: | Weight average particle diameter $D_4$ (ρm) | Volume average particle diameter Dv (μm) | Particle diameters: 5 μm or smaller Nr (no. %) | 3.17 μm or smaller Nm (no. %) | 3.17 μm or smaller Nv (vol. %) | 3.17 μm or smaller Nm/Nv | 8 μm or larger (vol. %) | True density ($g/cm^3$) | Quantity of triboelectricity (μC/g) |
|---|---|---|---|---|---|---|---|---|---|
| No. 1 | 8.0 | 7.1 | 32 | 6.0 | 0.1 | 60 | 48 | 1.1 | −40 |
| No. 2 | 8.0 | 7.1 | 34 | 7.0 | 0.1 | 70 | 48 | 1.1 | −46 |
| No. 3 | 7.0 | 6.2 | 42 | 7.2 | 1.0 | 7.2 | 26 | 1.05 | −37 |
| No. 4 | 7.0 | 6.2 | 42 | 7.9 | 1.0 | 7.9 | 26 | 1.05 | −41 |

EXAMPLE 9

As an electrophotographic apparatus, a laser beam printer (trade name: LBP-860, manufactured by Canon Inc.) was modified to operate at a process speed of 94 mm/sec and be able to print on 16 sheets of LTR size paper per minute. In the apparatus thus modified, a charging roller 21 to which DC and AC components are applied uniformly charges a photosensitive drum 26 (an image bearing member). At the time of charging, the DC component is controlled to a constant voltage, and the AC component to a constant current. After the charging, an electrostatically charged latent image is formed by exposing to laser light, which is then converted into a visible image (a toner image) with the toner, and thereafter the toner image is transferred to a transfer medium 28 by means of a transfer roller 27 to which a voltage has been applied.

A developing assembly 22 in the process cartridge was modified in the following way. A stainless steel sleeve, which serves as a toner feed member, was replaced with a medium-resistance rubber roller (diameter: 20 mm; mandrel diameter: 8 mm) made of an urethane foam and having an electric resistivity of $10^5$ Ω.cm, which was used as a toner carrying member 24 and was pressed to the photosensitive drum 26 to form a nip of about 3.5 mm. The toner carrying member was rotated in the same direction as the photosensitive member at a point of contact and at a peripheral speed of 150% of the rotational peripheral speed of the photosensitive member. The peripheral speed of the toner carrying member was 141 mm/sec, and that of the photosensitive member, 94 mm/sec.

As a means for coating the toner on the toner carrying member 24, a coating roller 25 was provided inside the developer container of the developing assembly 22 and was brought into touch with the toner carrying member. The toner was applied on the toner carrying member by rotating the coating roller 25 in the direction opposite to the rotation of the toner carrying member at the contact point. In order to control the thickness of the toner layer on the toner carrying member, a blade 23 made of stainless steel, coated with a resin, was attached. As a cleaning member, a blade 29 was provided in a cleaning assembly 30.

Photosensitive drum No. 1 and toner No. 2 were used, and process conditions were set as to satisfy the following developing conditions.

| | |
|---|---|
| Photosensitive drum dark area potential: | −700 V |
| Photosensitive drum light area potential: | −150 V |
| Development bias: | −450 V (DC component only) |

Supplying the toner, running on 20,000 sheets was tested to evaluate the images. Good results were obtained for both image density and fogging, and the same image quality as the initial stage was obtained after the running. At this point, the surface layer of the photosensitive drum was 15 μm thick, and both the photosensitive member and the developing roller (toner carrying member) were hardly deteriorated, and did not require replacement.

Results on the evaluation of image density and fog in the running test are shown in Table 4.

EXAMPLE 10

In the modified machine as used in Example 9, the toner carrying member was rotated in the same direction as the photosensitive member at the contact point and at a peripheral speed of 200% of the rotational peripheral speed of the photosensitive member. The peripheral speed of the toner carrying member was 188 mm/sec, and that of the photosensitive member, 94 mm/sec.

Photosensitive drum No. 3 and toner No. 2 were used, and process conditions were set to satisfy the following developing conditions.

| | |
|---|---|
| Photosensitive drum dark area potential: | −700 V |
| Photosensitive drum light area potential: | −150 V |
| Development bias: | −350 V (DC component only) |

Supplying the toner, running on 20,000 sheets was tested to evaluate the images. Good results were obtained on both image density and fog, and the same image quality as the initial stage was obtained also after the running. At this point, the surface layer (protective layer) of the photosensitive drum was 1 μm thick, and both the photosensitive member and the developing roller were hardly deteriorated, and did not require replacement.

Results of the evaluation of image density and fog in the running test are shown in Table 4.

EXAMPLE 11

As an electrophotographic apparatus, a laser beam printer (trade name: LBP-860, manufactured by Canon Inc.) was modified so as to operate at a process speed of 118 mm/sec and be able to print on 20 sheets of LTR size paper per minute. In the apparatus thus modified, a charging roller 21 to which DC and AC components are applied uniformly charged an image bearing member. At the time of charging, the DC component is controlled at a constant voltage, and the AC component at a constant current.

A developing assembly in the process cartridge was modified in the following way. A stainless steel sleeve, which serves as a toner feeder, was replaced with a medium-resistance rubber roller (diameter: 20 mm; mandrel diameter: 8 mm) provided with a dielectric layer on its surface, which was used as a toner carrying member and was pressed to the photosensitive drum. The toner carrying member was rotated in the same direction as the photosensitive member at the contact point and at a peripheral speed of 200% of the rotational peripheral speed of the photosensitive member. The peripheral speed of the toner carrying member was 236 mm/sec, and that of the photosensitive member, 118 mm/sec.

As a means for coating the toner on the toner carrying member, a coating roller was provided inside the developer container of the developing assembly and was brought into contact with the toner carrying member. The toner was applied to the toner carrying member by rotating the coating roller in the direction opposite to the rotation of the toner carrying member at the contact point. In order to control the thickness of the toner layer on the toner carrying member, a blade made of stainless steel, coated with a resin, was attached. As a cleaning member, a blade was provided in a cleaning assembly.

Photosensitive drum No. 3 and toner No. 4 were used, and process conditions were set to satisfy the following developing conditions.

| | |
|---|---|
| Photosensitive drum dark area potential: | −700 V |
| Photosensitive drum light area potential: | −150 V |
| Development bias: | −350 V (DC component only) |

Supplying the toner, running on 20,000 sheets was tested to evaluate the images. Good results were obtained for both image density and fogging, and the same image quality as the initial stage was obtained also after the running. At this point, the surface layer (protective layer) of the photosensitive drum was 1 μm thick, and both the photosensitive member and the developing roller were hardly deteriorated, and did not require replacement.

Results on the evaluation of image density and fog in the running test are shown in Table 4.

Comparative Example 3

Tests were made in the same manner as in Example 9 except that photosensitive drum No. 2 was used.

Process conditions were set to satisfy the following developing condition.

| | |
|---|---|
| Photosensitive drum dark area potential: | −700 V |
| Photosensitive drum light area potential: | −150 V |
| Development bias: | −450 V (DC component only) |

On the 12,000th sheet running, granular fog occurred on some areas of toner images synchronized with the rotational period of the photosensitive drum. The cause thereof was a faulty charging due to scraping of the image bearing member. At this stage, the layer thickness of the surface layer had decreased to 12 μm or less. Then the photosensitive drum was changed with new one. As a result, the granular fog disappeared, but the image density was not restored to the initial level.

After the running test on 20,000 sheets was completed, a new developing roller was assembled to examine the image density. As a result, the image density was restored to the initial level. The image density was also checked for the combination of a fresh toner and the developing roller used in 20,000 sheet running. The image density was 1.30 and was not restored to the initial level.

Results obtained are shown in Table 4.

Comparative Example 4

Tests were made in the same manner as in Example 9 except that toner No. 1 and photosensitive drum No. 2 were used.

Process conditions were set to satisfy the following developing condition.

| | |
|---|---|
| Photosensitive drum dark area potential: | −700 V |
| Photosensitive drum light area potential: | −150 V |
| Development bias: | −350 V (DC component only) |

On the 10,000th sheet running, granular fog occurred on some area of toner images synchronized with the rotational period of the photosensitive drum. The cause thereof was a faulty charging due to a scrape of the image bearing member. At this stage, the layer thickness of the surface layer had decreased to 11 μm or less. Then the photosensitive drum was changed with new one. As a result, the granular fog disappeared, but the image density was not restored to the initial level. The running was subsequently tested up to 20,000 sheet running.

After the running test on 20,000 sheets was completed, a new photosensitive drum and a new developing roller were assembled to examine the image density. As a result, the image density was restored to the initial level. The image density was also checked for the combination of a fresh toner and the developing roller used in 20,000 sheet running. The image density was 1.28 and was not restored to the initial level.

Results obtained are shown in Table 4.

Comparative Example 5

Tests were made in the same manner as in Example 9 except that photosensitive drum No. 2 and toner No. 3 were used.

Process conditions were set to satisfy the following developing condition.

| | |
|---|---|
| Photosensitive drum dark area potential: | −700 V |
| Photosensitive drum light area potential: | −150 V |
| Development bias: | −450 V (DC component only) |

On the 14,000th sheet running, granular fog occurred on some areas of toner images synchronized with the rotational period of the photosensitive drum. The cause thereof was a faulty charging due to a scrape of the image bearing member. At this stage, the layer thickness of the surface layer had decreased to 12 μm or less. Then the photosensitive drum was changed for new one. As a result, the granular fog disappeared but the image density was not restored to the initial level. The running was subsequently tested up to 20,000 sheet running.

After the running test on 20,000 sheets was completed, a new developing roller was assembled to examine the image density. The density was 1.16 and was not restored to the initial level.

Results obtained are shown in Table 4.

Comparative Example 6

Tests were made in the same manner as in Example 10 except that photosensitive drum No. 2 and toner No. 3 were used. Results obtained are shown in Table 4. On the 14,000th sheet running, the photosensitive drum was changed with new one. After the running test on 20,000 sheets, a new developing roller was assembled, but the image density was not restored to the initial level.

Results obtained are shown in Table 4.

TABLE 4

| Toner | Image bearing member | Toner quantity on toner carrying member M/S (g/m²) | Image density Initial | Image density 10,000 sheets | Image density 20,000 sheets | Fog quantity (%) Initial | Fog quantity (%) 10,000 sheets | Fog quantity (%) 20,000 sheets |
|---|---|---|---|---|---|---|---|---|
| Example: | | | | | | | | |
| 9 No. 2 | 1 | 60 | 1.40 | 1.41 | 1.42 | 0.8 | 1.1 | 0.4 |
| 10 No. 2 | 3 | 50 | 1.39 | 1.40 | 1.39 | 1.0 | 0.8 | 0.7 |
| 11 No. 4 | 3 | 50 | 1.42 | 1.43 | 1.42 | 0.7 | 0.6 | 0.3 |
| Comparative Example: | | | | | | | | |
| 3 No. 2 | 2 | 60 | 1.40 | 1.30 | 1.15 | 0.8 | 5.1 | 8.4 |
| 4 No. 1 | 2 | 30 | 1.20 | 1.15 | 1.10 | 1.8 | 5.4 | 10.8 |
| 5 No. 3 | 2 | 30 | 1.18 | 1.04 | 1.00 | 2.4 | 8.7 | 12.4 |
| 6 No. 3 | 2 | 25 | 1.22 | 1.10 | 1.05 | 2.4 | 7.3 | 11.8 |

EXAMPLE 12

A photosensitive belt was produced in the same manner as in Image Bearing Member Production Example 1 except that a nickel-electroformed seamless belt of 254 mm long and 254 mm wide was used as the substrate. The contact angle with water of the surface was 97°.

FIG. 5 shows an example of the image forming apparatus employing such a photosensitive belt and a developing elastic roller.

Images were reproduced under the same conditions as in Example 1 where the image forming apparatus employing the photosensitive drum and the developing elastic roller as shown in FIG. 2, except that as shown in FIG. 5 the toner carrying elastic roller was brought into touch with the photosensitive belt to form a developing nip.

Supplying the toner, running on 20,000 sheets was tested to evaluate the images. Good results were obtained for both image density and fogging, and the same image quality as the initial stage was obtained also after the running. At this point, the surface layer of the photosensitive belt was 15 μm thick, and both the photosensitive belt and the developing roller (toner carrying member) were hardly deteriorated, and did not require replacement.

As is clear from the above Examples, the image forming method of the present invention makes it possible to prevent the toner being laid in excess on line images while maintaining the reproduction of fine latent images and also to stably provide high-quality images with less black spots around line images and less fog over a long period of use. It is also possible for the image bearing member and the toner carrying member to enjoy a long service life.

What is claimed is:

1. An image forming method comprising the steps of:

forming an electrostatic latent image on an image bearing member having a surface of which a contact angle with water is at least 90°;

forming a toner layer on a toner carrying member;

bringing the toner layer into contact with the surface of the image bearing member on which the electrostatic latent image has been formed, while rotating the image bearing member and the toner carrying member reciprocally; and developing the electrostatic latent image by the use of the toner of the toner layer to form a toner image, wherein said toner contains at least toner particles having a binder resin and a colorant and an inorganic powder, and said toner has a volume average particle diameter Dv (μm) of 3 μm≦Dv≦8 μm, a weight average particle diameter $D_4$ (μm) of $3.5 \leqq D_4 \leqq 9$, and a percentage Nr of particles of diameters not larger than 5 μm in number particle size distribution, of 17% by number≦Nr≦90% by number.

2. The image forming method according to claim 1, wherein said image bearing member contains in its surface layer a releasing powder having a fluorine atom.

3. The image forming method according to claim 2, wherein said image bearing member contains in its surface layer a fluorine resin powder.

4. The image forming method according to claim 3, wherein said image bearing member contains in its surface layer a polytetrafluoroethylene powder.

5. The image forming method according to claim 1, wherein said image bearing member is electrostatically charged by a contact charging means.

6. The image forming method according to claim 1, wherein said toner has a volume average particle diameter Dv (μm) of 3 μm≦Dv≦6 μm, a weight average particle diameter $D_4$ (μm) of 3.5 μm≦$D_4$<6.5 μm, and a percentage Nr of particles with diameters not larger than 5 μm in number particle size distribution, of 60% by number≦Nr≦90% by number.

7. The image forming method according to claim 1, wherein said toner has the ratio of percentage Nm of particles with diameters not larger than 3.17 μm in number particle size distribution to percentage Nv of particles with diameters not larger than 3.17 μm in volume particle size distribution, Nm/Nv, of from 2.0 to 8.0, and a volume percentage of toner particles with diameters not smaller than 8 μm in volume particle size distribution, of not more than 10% by volume.

8. The image forming method according to claim 1, wherein said toner has the ratio of percentage Nm of particles with diameters not larger than 3.17 μm in number particle size distribution to percentage Nv of particles with diameters not larger than 3.17 μm in volume particle size distribution, Nm/Nv, of 3.0 to 7.0.

9. The image forming method according to claim 1, wherein said inorganic fine powder is selected from the group consisting of titania, alumina, silica, and composite oxides of any of these.

10. The image forming method according to claim 1, wherein said toner has a charge quantity as its absolute value (mC/kg) of 14≦Q≦80 mC/kg (μC/g), where Q is a quantity of triboelectricity to iron powder.

11. The image forming method according to claim 10, wherein said absolute value (mC/kg) of charge quantity is 24≦Q≦60 mC/kg (μC/g).

12. The image forming method according to claim 1, wherein said toner carrying member is rotated at a peripheral speed of 100% or more of the peripheral speed of said image bearing member.

13. The image forming method according to claim 12, wherein said toner carrying member is rotated at a peripheral speed of 120% to 300% of the peripheral speed of said image bearing member.

14. The image forming method according to claim 13, wherein said toner carrying member is rotated at a peripheral speed of 140% to 250% of the peripheral speed of said image bearing member.

15. The image forming method according to claim 1, wherein said toner is applied on the toner carrying member in thin layer of not more than two layers.

16. The image forming method according to claim 1, wherein said toner carrying member carries the toner in a developing zone in a quantity of 0.4×D×ρ to 1.1×D×ρ ($g/m^2$) per unit area, where D represents a weight average particle diameter (μm) of the toner and ρ represents a true density ($g/cm^3$) of the toner.

17. The image forming method according to claim 16, wherein said toner is carried on said toner carrying member in a quantity of 0.5×D×ρ to 1.0×D×ρ ($g/m^2$).

18. The image forming method according to claim 17, wherein said toner is carried on said toner carrying member in a quantity of 0.6×D×ρ to 0.95×D×ρ ($g/m^2$).

19. A process cartridge comprising developing means and an image bearing member for bearing an electrostatic latent image, wherein said developing means and said image bearing member are held into one unit as a cartridge and said process cartridge is detachable from a main body of an image forming apparatus, and wherein said image bearing member has a surface of which a contact angle with water is at least 90°; and said developing means has toner and a toner carrying member and is so provided as to be able to develop the electrostatic latent image while a toner layer formed on the toner carrying member comes into contact with the surface of the image bearing member, and wherein said toner contains at least toner particles having a binder resin and a colorant and an inorganic powder, and said toner has a volume average particle diameter Dv (μm) of 3 μm≦Dv≦8 μm, a weight average particle diameter $D_4$ (μm) of 3.5 μm≦$D_4$≦9 μm, and a percentage Nr of particles with diameters not larger than 5 μm in number particle size distribution, of 17% by number≦Nr≦90% by number.

20. The process cartridge according to claim 19, wherein said image bearing member contains in its surface layer a releasing powder having a fluorine atom.

21. The process cartridge according to claim 19, wherein said image bearing member contains in its surface layer a fluorine resin powder.

22. The process cartridge according to claim 21, wherein said image bearing member contains in its surface layer a polytetrafluoroethylene powder.

23. The process cartridge according to claim 9, wherein said image bearing member is in pressure contact with a contact charging means.

24. The process cartridge according to claim 19, wherein said toner has a volume average particle diameter Dv (μm) of 3 μm≦Dv≦6 μm, a weight average particle diameter $D_4$ (μm) of 3.5 μm≦$D_4$<6.5 μm, and percentage Nr of particles with diameters not larger than 5 μm in number particle size distribution, of 60% by number≦Nr≦90% by number.

25. The process cartridge according to claim 19, wherein said toner has the ratio of percentage Nm of particles with diameters not larger than 3.17 μm in number particle size distribution to percentage Nv of particles with diameters not larger than 3.17 μm in volume particle size distribution, Nm/Nv, of 2.0 to 8.0, and a volume percentage of toner particles with diameters not smaller than 8 μm in volume particle size distribution, of not more than 10% by volume.

26. The process cartridge according to claim 19, wherein said toner has the ratio of percentage Nm of particles with diameters not larger than 3.17 μm in number particle size distribution to percentage Nv of particles with diameters not larger than 3.17 μm in volume particle size distribution, Nm/Nv, of 3.0 to 7.0.

27. The process cartridge according to claim 19, wherein said inorganic fine powder is selected from the group consisting of titania, alumina, silica, and composite oxides of any of these.

28. The process cartridge according to claim 19, wherein said toner has a charge quantity as its absolute value (mC/kg) of $14 \leqq Q \leqq 80$ mC/kg (μC/g), where Q is a quantity of triboelectricity to iron powder.

29. The process cartridge according to claim 28, wherein said absolute value (mC/kg) of charge quantity is $24 \leqq Q \leqq 60$ mC/kg (μC/g).

30. The process cartridge according to claim 19, wherein said toner is applied on the toner carrying member in thin layer of not more than two layers.

31. The process cartridge according to claim 19, wherein said toner carrying member carries the toner in a developing zone in a quantity of $0.4 \times D \times \rho$ to $1.1 \times D \times \rho$ ($g/m^2$) per unit area, where D represents a weight average particle diameter (μm) of the toner and ρ represents a true density ($g/cm^3$) of the toner.

32. The process cartridge according to claim 31, wherein said toner is carried on said toner carrying member in a quantity of $0.5 \times D \times \rho$ to $1.0 \times D \times \rho$ ($g/m^2$).

33. The process cartridge according to claim 32, wherein said toner is carried on said toner carrying member in a quantity of $0.6 \times D \times \rho$ to $0.95 \times D \times \rho$($g/m^2$).

* * * * *

UNITED STATES PATENT AND TRADEMARK OFFICE

CERTIFICATE OF CORRECTION

PATENT NO. : 5,715,501

DATED : February 3, 1998

INVENTOR(S) : SHUICHI AITA ET AL.

It is certified that error appears in the above-identified patent and that said Letters Patent is hereby corrected as shown below:

COLUMN 1

Line 60, "has" should read --have--.
Line 61, "become" should read --come--.

COLUMN 3

Line 8, "improve" should read --improves--.
Line 27, "comprising;" should read --comprising:--.
Line 45, "wherein;" should read --wherein,--.

COLUMN 5

Line 2, "charging, i.e." should read --charging--; and "charging" (second occurrence) should read --charging, i.e.,--.
Line 3, "touch" should read --contact--.
Line 62, "of" should be deleted.

COLUMN 8

Line 37, "5 μis" should read --5 μm is--.

COLUMN 11

Line 53, "based," should read --based--.

COLUMN 15

Table 1, Col. 2, "(pm)" should read --(μm)--.

UNITED STATES PATENT AND TRADEMARK OFFICE

CERTIFICATE OF CORRECTION

PATENT NO. : 5,715,501

DATED : February 3, 1998

INVENTOR(S) : SHUICHI AITA ET AL.

It is certified that error appears in the above-identified patent and that said Letters Patent is hereby corrected as shown below:

COLUMN 17

Line 15, "unnecessiating" should read --unnecessitating--.
Line 51, ". The" should read --, the--.

COLUMN 21

Table 3, Col. 2, "(pm)" should read --(μm)--.

COLUMN 28

Line 18, "90°;" should read --90°--.
Line 41, "claim 9," should read --claim 19,--.

Signed and Sealed this

First Day of December, 1998

Bruce Lehman

*Attest:*

BRUCE LEHMAN

*Attesting Officer*

*Commissioner of Patents and Trademarks*